US010781068B2

(12) United States Patent
Wagatsuma

(10) Patent No.: US 10,781,068 B2
(45) Date of Patent: Sep. 22, 2020

(54) IMAGE FORMING SYSTEM WHICH PERFORMS INSERTION PAPER PROCESSING CONTROL, CONTROL METHOD OF IMAGE FORMING SYSTEM, AND PROGRAM

(71) Applicant: KONICA MINOLTA, INC., Chiyoda-ku, Tokyo (JP)

(72) Inventor: Yoshifumi Wagatsuma, Kunitachi (JP)

(73) Assignee: KONICA MINOLTA, INC., Tokyo (JP)

( * ) Notice: Subject to any disclaimer, the term of this patent is extended or adjusted under 35 U.S.C. 154(b) by 35 days.

(21) Appl. No.: 16/212,674

(22) Filed: Dec. 6, 2018

(65) Prior Publication Data

US 2019/0185285 A1 Jun. 20, 2019

(30) Foreign Application Priority Data

Dec. 19, 2017 (JP) ..... 2017-242307

(51) Int. Cl.
*B65H 43/06* (2006.01)
*B65H 37/06* (2006.01)
(Continued)

(52) U.S. Cl.
CPC ..... *B65H 37/06* (2013.01); *B65H 29/14* (2013.01); *B65H 31/10* (2013.01); *B65H 33/04* (2013.01);
(Continued)

(58) Field of Classification Search
CPC .... B65H 37/06; B65H 45/18; B65H 35/0033; B65H 43/06; B65H 31/10; B65H 29/14; B65H 39/10; B65H 45/12; G03G 15/655
See application file for complete search history.

(56) References Cited

U.S. PATENT DOCUMENTS 5,257,081 A * 10/1993 Kato ..... G03G 15/50 270/32
5,709,374 A * 1/1998 Taylor ..... B65H 33/04 270/1.02
(Continued)

FOREIGN PATENT DOCUMENTS

JP 2002211069 A 7/2002

OTHER PUBLICATIONS

Chinese Office Action (and English language translation thereof) dated Apr. 22, 2020 issued in Chinese Application No. 201811532226.0.

*Primary Examiner* — Patrick H Mackey
(74) *Attorney, Agent, or Firm* — Holtz, Holtz & Volek PC

(57) ABSTRACT

An image forming system includes: an image former that forms an image on a paper sheet; a post-processor that executes post-processing on the paper sheet; a paper sheet stacker that stacks the paper sheet output from the post-processor on a paper discharge tray; and a hardware processor that controls the image former, the post-processor, and the paper sheet stacker, wherein in a case where insertion paper is output to the paper sheet stacker and is placed on an uppermost paper sheet on the paper discharge tray, when it is determined that a size of the insertion paper is larger than a size of the uppermost paper sheet by a predetermined size determination value or more, the hardware processor executes insertion paper processing control for changing an outer shape of the insertion paper to change the size of the insertion paper and outputting the insertion paper to the paper sheet stacker.

15 Claims, 7 Drawing Sheets

(51) Int. Cl.

| | |
|---|---|
| ***B65H 29/14*** | (2006.01) |
| ***B65H 45/18*** | (2006.01) |
| ***B65H 35/00*** | (2006.01) |
| ***B65H 33/04*** | (2006.01) |
| ***B65H 31/10*** | (2006.01) |

(52) U.S. Cl.

CPC ..... *B65H 35/0033* (2013.01); *B65H 43/06* (2013.01); *B65H 45/18* (2013.01); *B65H 2301/4263* (2013.01); *B65H 2404/1441* (2013.01); *B65H 2511/10* (2013.01); *B65H 2511/11* (2013.01); *B65H 2511/12* (2013.01); *B65H 2511/30* (2013.01); *B65H 2801/27* (2013.01)

(56) References Cited

U.S. PATENT DOCUMENTS

| | | | | | |
|---|---|---|---|---|---|
| 5,966,579 | A * | 10/1999 | Asai | B65H 37/06 399/407 |
| 9,643,430 | B2 * | 5/2017 | Kato | G03G 15/655 |
| 10,065,824 | B2 * | 9/2018 | Edo | B65H 29/12 |
| 2019/0233242 | A1 * | 8/2019 | Wakabayashi | B65H 33/04 |

* cited by examiner

IMAGE FORMING SYSTEM WHICH PERFORMS INSERTION PAPER PROCESSING CONTROL, CONTROL METHOD OF IMAGE FORMING SYSTEM, AND PROGRAM

The entire disclosure of Japanese patent Application No. 2017-242307, filed on Dec. 19, 2017, is incorporated herein by reference in its entirety.

BACKGROUND

Technological Field

The present invention relates to an image forming system, a control method of the same, and a program.

Description of the Related Art

Conventionally, an image forming system including an image forming device and a post-processing device for executing various post-processing has been known. In addition, the image forming system includes a paper sheet stacking device which is provided on the most downstream side of the system and in which paper sheets output from devices on the upstream side are stacked on a paper discharge tray. The paper sheet stacking device has the paper discharge tray which can ascend and descend along a paper sheet stacking direction so as to discharge a large number of paper sheets.

In this kind of paper sheet stacking device, by inserting insertion paper between the paper sheets stacked on the paper discharge tray, the paper sheets are partitioned from each other. The insertion paper is inserted, for example, at a timing when a job is completed, or when printing on a certain group of the paper sheets is completed in a case Where printing on a plurality of groups of paper sheets is performed. Accordingly, it is possible to easily separate a bundle of paper sheets in units of jobs or groups from among the paper sheets stacked on the paper discharge tray by using the insertion paper as an index.

For example, JP 2002-211069 A discloses a print control device which prevents a collapse of stacked printed matters caused by stacking printed matters having different sizes on a stacker. The print control device compares the sizes of a plurality of pieces of print data, and determines an outputting order of the print data based on the size of each print data. By outputting the plurality of pieces of print data to a print unit based on the determined output order, the collapse of the stacked printed matters is prevented.

Incidentally, from the viewpoint of ease of handling, it is preferable to use a paper sheet larger than a paper sheet used for a job as insertion paper. On the other hand, since the insertion paper simply partitions the paper sheets and is not an important paper sheet, it is not reasonable to prepare various sizes of insertion paper. Therefore, the largest paper sheet is used as insertion paper. However, since the sizes of the paper sheets used for jobs vary, it is considered that the size of the paper sheet stacked on the paper discharge tray is smaller than the size of the insertion paper. In this case, there is a possibility that the insertion paper is largely extended beyond the paper sheet on the paper discharge tray and drops due to self-weight. As a result, there is a problem in that the insertion paper cannot be appropriately inserted.

SUMMARY

The present invention has been made in view of the above circumstances, and an object of the present invention is to provide an image forming system capable of appropriately inserting insertion paper regardless of a size of a paper sheet used for a job, a control method of the same, and a program.

To achieve the abovementioned object, according to an aspect of the present invention, an image forming system reflecting one aspect of the present invention comprises: an image former that forms an image on a paper sheet; a post-processor that executes post-processing on the paper sheet; a paper sheet stacker that stacks the paper sheet output from the post-processor on a paper discharge tray; and a hardware processor that controls the image former, the post-processor, and the paper sheet stacker, wherein in a case where insertion paper for partitioning paper sheets by being inserted between the paper sheets is output to the paper sheet stacker and is placed on an uppermost paper sheet on the paper discharge tray, when it is determined that a size of the insertion paper is larger than a size of the uppermost paper sheet by a predetermined size determination value or more, the hardware processor executes insertion paper processing control for changing an outer shape of the insertion paper by using the post-processor to change the size of the insertion paper and outputting the insertion paper to the paper sheet stacker.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Hereinafter, one or more embodiments of the present invention will be described with reference to the drawings. However, the scope of the invention is not limited to the disclosed embodiments.

First Embodiment

Figure 1:
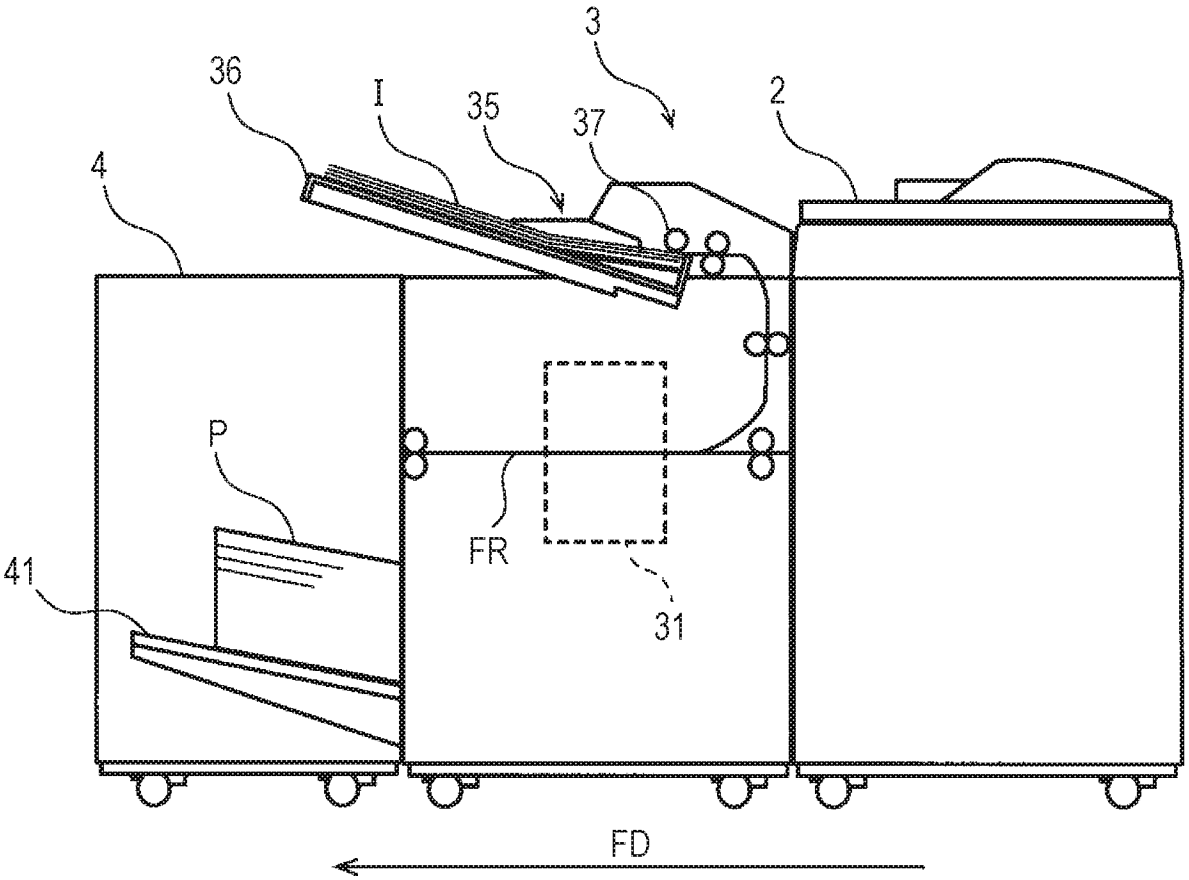
FIG. 1 is an explanatory diagram schematically illustrating a configuration of an image forming system according to a first embodiment.
Figure 2:
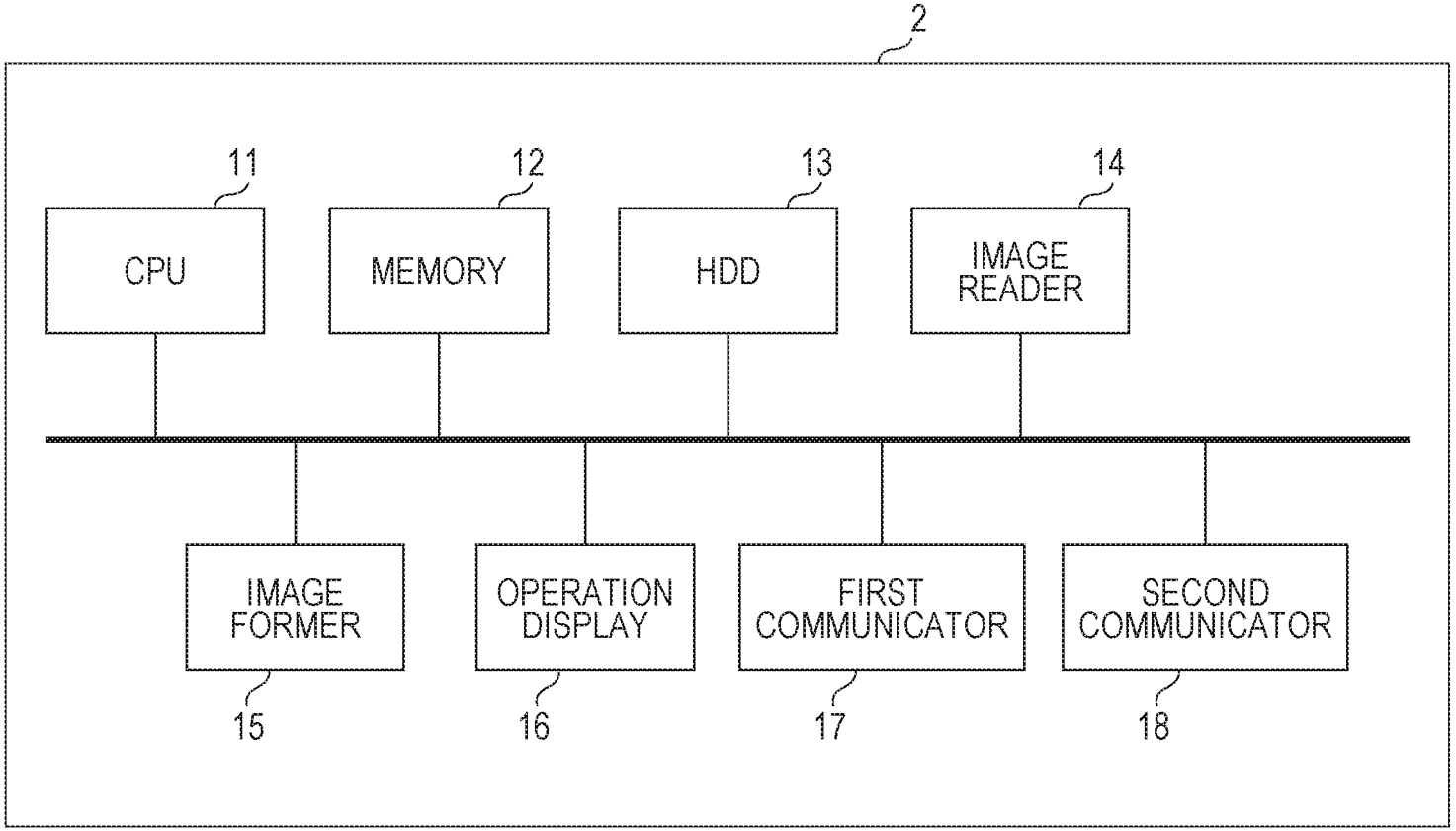
FIG. 2 is a block diagram of a configuration of an image forming device according to the first embodiment.
Figure 3:
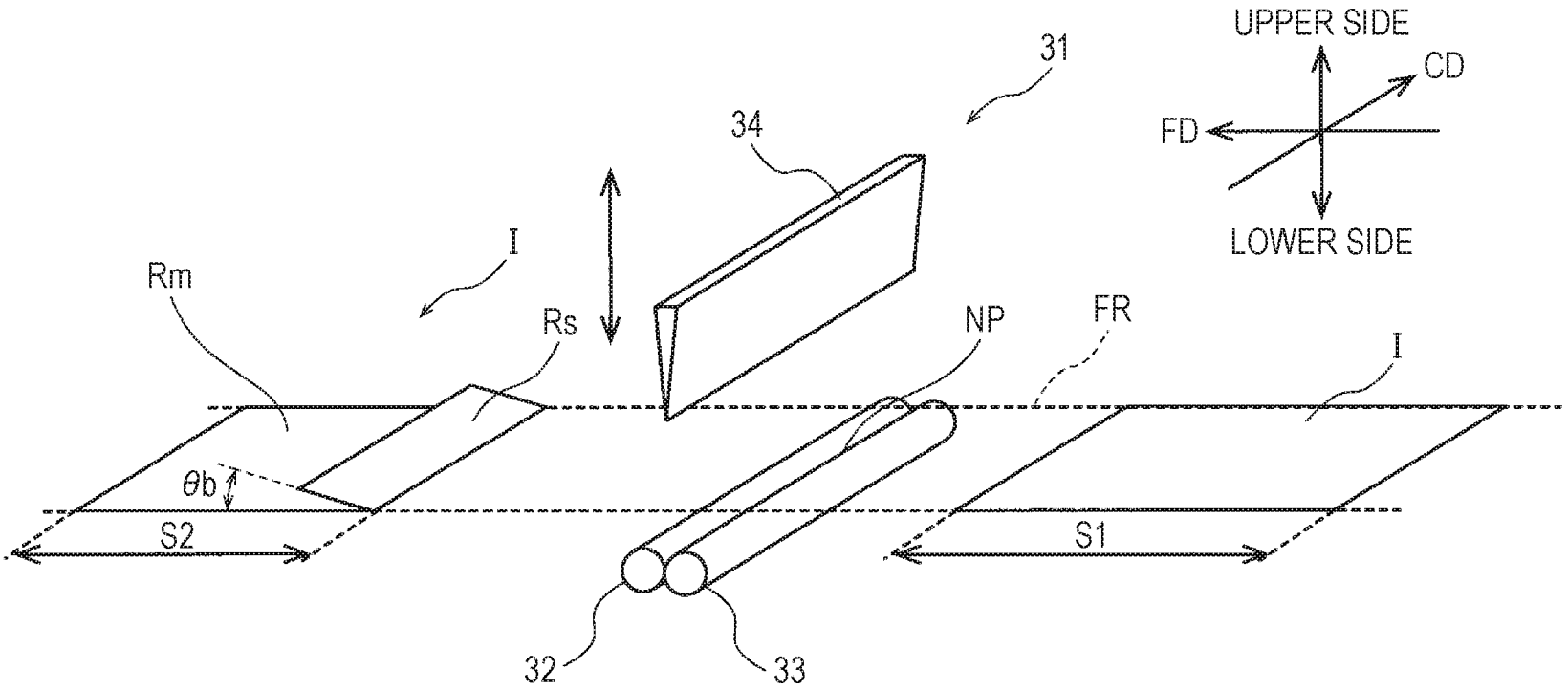
FIG. 3 is an explanatory diagram schematically illustrating a configuration of a folding processor.

Hereinafter, an image forming system 1 according to the present invention will be described. Here, FIG. 1 is an explanatory diagram schematically illustrating a configuration of the image forming system 1 according to the present embodiment. FIG. 2 is a block diagram of a configuration of an image forming device 2 according to the present embodiment. In addition, FIG. 3 is an explanatory diagram schematically illustrating a configuration of a folding processor 31. For convenience of the description of the image forming system 1 according to the present embodiment, a term of a "size of a paper sheet P" is used as a dimension along a paper sheet conveyance direction FD.

The image forming system 1 according to the present embodiment mainly includes the image forming device 2, a post-processing device 3, and a paper sheet stacking device 4. The image forming device 2, the post-processing device 3, and the paper sheet stacking device 4 are sequentially arranged in this order from the upstream side in the paper sheet conveyance direction FD to the downstream side.

The image forming device 2 forms an image on the paper sheet P and outputs the paper sheet P on which the image has been formed to a device on the downstream side. The image forming device 2 has a function for executing a job such as a copy job for optically reading a document and outputting the read image data on the paper sheet P, a print job for outputting image data output from an external device (hard disk device, server, personal computer, and the like) on the paper sheet P, and the like.

The image forming device 2 includes a Central Processing Unit (CPU) 11 which integrally controls an operation of the image forming system 1 including the image forming device 2, the post-processing device 3, and the paper sheet stacking device 4. The CPU 11 is connected to a memory 12, a hard disk drive (HDD) 13, an image reader 14, an image former 15, an operation display 16, a first communicator 17, and a second communicator 18 via a bus.

The CPU 11 is operated based on an Operating System (OS) and executes various programs and the like on the OS. The memory 12 stores a program to activate the image forming system 1, and the CPU 11 activates the image forming system 1 according to the program. Thereafter, the CPU 11 loads programs stored in the hard disk drive 13 to the memory 12 and executes various processing according to the loaded program so as to realize various functions of the image forming system 1 (processor).

The memory 12 includes a Read Only Memory (ROM), a Random Access Memory (RAM), and the like. The RAM is a working storage region for temporarily storing various data when the CPU 11 executes processing based on the programs.

The hard disk drive 13 is a large-capacity nonvolatile storage device and stores OS programs, jobs, and the like. The hard disk drive 13 stores the program executed by the CPU 11 to operate the image forming device 2, the post-processing device 3, and the paper sheet stacking device 4 according to their functions. In addition, the hard disk drive 13 stores data necessary for execution of the programs and management of the image forming device 2, the post-processing device 3, and the paper sheet stacking device 4.

When obtaining an image signal by optically reading an image of a document, the image reader 14 performs A/D conversion processing on the image signal to generate image data. The image reader 14 includes, for example, a light source, an imaging device such as Charge Coupled Devices (CCD) which converts light reflected by the document into an electric signal, and an A/D converter.

The image former 15 forms an image according to the image data on the paper sheet P and outputs the paper sheet P on which the image has been formed. The image former 15 according to the present embodiment has a configuration using, for example, an electrophotographic process, and includes a conveyance device including a conveyance roller, a photosensitive drum, a charging device, an exposure device, a developing device, a transfer separation device, a cleaning device, a fixing device, and the like. However, the image former 15 may have a configuration using other methods such as an ink jet method.

The operation display 16 is an operator which receives an input according to a user's operation and includes, for example, a display, a touch panel to which information can be input according to information displayed on the display, and various switches and buttons. Information on the operation made on the operation display 16 is input to the CPU 11. By operating the operation display 16, the user can issue a print job and make various settings. In addition, under the control of the CPU 11, the operation display 16 functions as a display which displays various information to the user.

The first communicator 17 functions as an interface which establishes communication between the post-processing device 3 and the paper sheet stacking device 4. With this function, the CPU 11 can mutually communicate with the post-processing device 3 and the paper sheet stacking device 4 via the first communicator 17.

The second communicator 18 is an interface connected to a network such as a Local Area Network (LAN). The second communicator 18 can accept a job from an external device via the network.

The post-processing device 3 executes post-processing on the paper sheet P output from the image forming device 2 and outputs the post-processed paper sheet P to a device on the downstream side. Operation modes of the post-processing device 3 include an operation mode for outputting the paper sheet P supplied to the post-processing device 3 without executing post-processing on the paper sheet P and an operation mode for executing the post-processing on the paper sheet P and outputting the paper sheet P (the same applies to insertion paper I to be described later).

The post-processing device 3 includes a folding processor 31. The folding processor 31 executes folding processing for folding the paper sheet P as the post-processing relative to the paper sheet P (post-processor). The folding processor 31 mainly includes a pair of folding rollers 32 and 33 and a folding knife 34.

Each of the pair of folding rollers 32 and 33 is configured of a roller of which an outer surface is covered with an elastic layer, and a roller axis of the folding roller is arranged along a paper sheet width direction CD perpendicular to the paper sheet conveyance direction FD. The pair of folding rollers 32 and 33 is pressed against each other to fold the paper sheet P with a predetermined folding force and forms a nip NP.

The folding knife 34 is a flat member and is arranged on the opposite side of the pair of folding rollers 32 and 33 across a conveyance path FR. The folding knife 34 is arranged along a tangent line direction of the nip NP so that the front end faces the nip NP of the pair of folding rollers 32 and 33 (initial position).

The folding knife 34 is configured to be linearly movable along the tangent line direction of the nip NP. By receiving a driving force from a power mechanism (not shown), the folding knife 34 can perform forward and backward movement in which the folding knife 34 enters between the pair of folding rollers 32 and 33 (nip NP) and retracts from this state to the initial position.

Furthermore, the post-processing device 3 includes an insertion paper supplier 35 which supplies the insertion paper I to the post-processing device 3. Here, the insertion paper I is a paper sheet which partitions the paper sheets P by being inserted between the paper sheets P stacked on the paper sheet stacking device 4. A paper sheet larger than the largest paper sheet P which can be used for jobs is selected as the insertion paper I.

The insertion paper supplier 35 includes an insertion paper placing part 36 and a paper sheet feeder 37. One or more sheets of insertion paper I are placed on the insertion paper placing part 36. The paper sheet feeder 37 takes in the uppermost insertion paper I from among the one or more sheets of insertion paper I placed on the insertion paper placing part 36 and feeds the insertion paper I to the conveyance path FR. The insertion paper I fed by the paper sheet feeder 37 joins the conveyance path FR at a point on the upstream side of the folding processor 31. As a result, after passing through the folding processor 31, the insertion paper I is output to the paper sheet stacking device 4. As conveying the insertion paper I, the folding processor 31 can execute the folding processing on the insertion paper I as necessary.

As a method of supplying the insertion paper I to the post-processing device 3, in addition to a method using the insertion paper supplier 35 mounted in the post-processing device 3, the image forming device 2 can be used. Specifically, the image forming device 2 includes a plurality of paper sheet trays in which the paper sheets P used for jobs are housed, and the paper sheet P is fed from the paper sheet tray. By housing the insertion paper I in one of the paper sheet trays and feeding the insertion paper I from the paper sheet tray, the paper sheet tray can be used as the insertion paper supplier 35. However, since various paper sheets P can be housed in paper sheet trays included in the image forming device 2 by providing the insertion paper supplier 35 in the post-processing device 3, it is possible to deal with various jobs.

The folding processing executed by the folding processor 31 in the post-processing device 3 having such a configuration will be described. Hereinafter, folding processing relative to the insertion paper I will be exemplified. However, the same applies to processing relative to the paper sheet P on which an image has been formed. First, when the insertion paper I conveyed through the conveyance path FR reaches the folding processor 31, the insertion paper I is stopped at a predetermined position. When the insertion paper I is stopped, the folding knife 34 is moved toward the insertion paper I, and the insertion paper I is inserted into the nip NP between the pair of folding rollers 32 and 33. By applying pressure to the pair of folding rollers 32 and 33 from both sides, the insertion paper I is folded along the paper sheet width direction CD. When the insertion paper I is folded, the folding knife 34 is moved in a direction separating from the pair of folding rollers 32 and 33 and returns to the initial position.

In this way; by folding the insertion paper I along the paper sheet width direction CD, the folding processor 31 changes an outer shape of the insertion paper I so as to change the size of the insertion paper I. That is, the insertion paper I on which the folding processing has been performed has a size S2 which is smaller than a size S1 before the folding processing by a folded paper sheet region (referred to as "folded region" below) Rs.

Furthermore, by controlling the position where the insertion paper I is stopped relative to the folding processor 31, the folding position of the insertion paper I can be adjusted. That is, by controlling the stop position of the insertion paper I, the size of the insertion paper I can be freely adjusted.

Furthermore, by adjusting a degree of the pressure applied to the pair of folding rollers 32 and 33, the folding processor 31 can adjust the folding force applied to the insertion paper I. That is, by making the pair of folding rollers 32 and 33 be close to each other and bring them into tight pressure contact with each other, a strong folding force can be realized. As a result, when the insertion paper I is placed on a paper discharge tray 41, a finished state in which the folded region Rs overlaps with a main region Rm of the insertion paper I or a finished state in which an angle formed by the folded region Rs and the main region Rm of the insertion paper I (referred to as "folded angle" below) θb becomes small can be obtained.

Similarly, by separating the pair of folding rollers 32 and 33 from each other and bringing them into loose pressure contact with each other, a weak folding force can be realized. As a result, when the insertion paper I is placed on the paper discharge tray 41, a finished state in which the folded angle θb increases can be obtained.

By adjusting the pair of folding rollers 32 and 33, the folding processor 31 can execute the folding processing with a folding force equal to or stronger than a predetermined set value and folding processing with a folding force equal to or weaker than the predetermined set value. The adjustment of the pair of folding rollers 32 and 33 may be manually made by a serviceman or a user, and it is possible that a driving mechanism for driving the pair of folding rollers 32 and 33 is mounted in the post-processing device 3 and the CPU 11 automatically adjusts the pair of folding rollers 32 and 33 according to an instruction from the serviceman or the user.

In the present embodiment, in the folding processor 31, the folding knife 34 is arranged above the pair of folding rollers 32 and 33 (refer to FIG. 3). In this case, the insertion paper I is in a folded state in which the folded region Rs is folded over toward the upper side of a paper surface (main region Rm of insertion paper I) (this folded state is referred to as "upward folding" below). However, the folding processor 31 may employ a configuration in which the folding knife 34 is arranged below the pair of folding rollers 32 and 33. In this case, a folded state is made in which the folded region Rs is folded over toward the lower side of a paper surface (main region Rm of insertion paper I) (this folded state is referred to as "downward folding" below). Furthermore, in the present embodiment, the post-processing device 3 includes the single folding processor 31. However, the post-processing device 3 may include two folding processors 31. In this case, by using one folding processor 31 for upward folding and the other folding processor 31 for downward folding, both of the upward folding and the downward folding can be performed, or one of them can be selectively performed.

The paper sheet stacking device 4 is a paper sheet stacker which stacks and accommodates the paper sheet P output from the post-processing device 3. The paper sheet stacking device 4 includes the paper discharge tray 41 and a lifting mechanism (not shown). The paper discharge tray 41 is a tray which sequentially stacks the paper sheets P output from the post-processing device 3. The paper discharge tray 41 can ascend and descend along a paper sheet stacking direction (vertical direction) by the lifting mechanism and is controlled so that the uppermost paper sheet P on the paper discharge tray 41 is maintained to be positioned at a predetermined height.

In the image forming system 1 according to the present embodiment, the CPU 11 executes the following functions by controlling the post-processing device 3. Specifically, the CPU 11 outputs the insertion paper I to the paper sheet stacking device 4 and places the insertion paper I on the uppermost paper sheet P on the paper discharge tray 41. The insertion paper I plays a role of partitioning the paper sheets P, for example, at a boundary between jobs. Therefore, the CPU 11 controls the output of the insertion paper I to the paper sheet stacking device 4 between an output of a preceding paper sheet P, that is, a final paper sheet P of the previous job to an output of a subsequent paper sheet P, that is, the first paper sheet P of the next job.

In this case, the CPU 11 determines whether the size of the insertion paper I is larger than the size of the uppermost paper sheet P on the paper discharge tray 41 (paper sheet P used for previous job) by a predetermined size determination value or more. This determination is made before the insertion paper I passes through the folding processor 31. When it is determined that a size difference is equal to or larger than the size determination value, the CPU 11 changes the size of the insertion paper I by folding the insertion paper I by the folding processor 31, and then, outputs the folded insertion paper I to the paper sheet stacking device 4. The CPU 11 executes the series of controls as insertion paper processing control.

Furthermore, in the present embodiment, the CPU 11 can accumulate a plurality of jobs input to the image forming system 1. Then, the CPU 11 sequentially executes the plurality of accumulated jobs from the job which uses a larger paper sheet P.

These functions of the CPU 11 are realized by executing the program by the CPU 11. That is, the CPU 11 is positioned as a controller for controlling the image forming system 1. Apart of the functions realized by the CPU 11 is realized by hardware including a circuit and the like.

Figure 4:
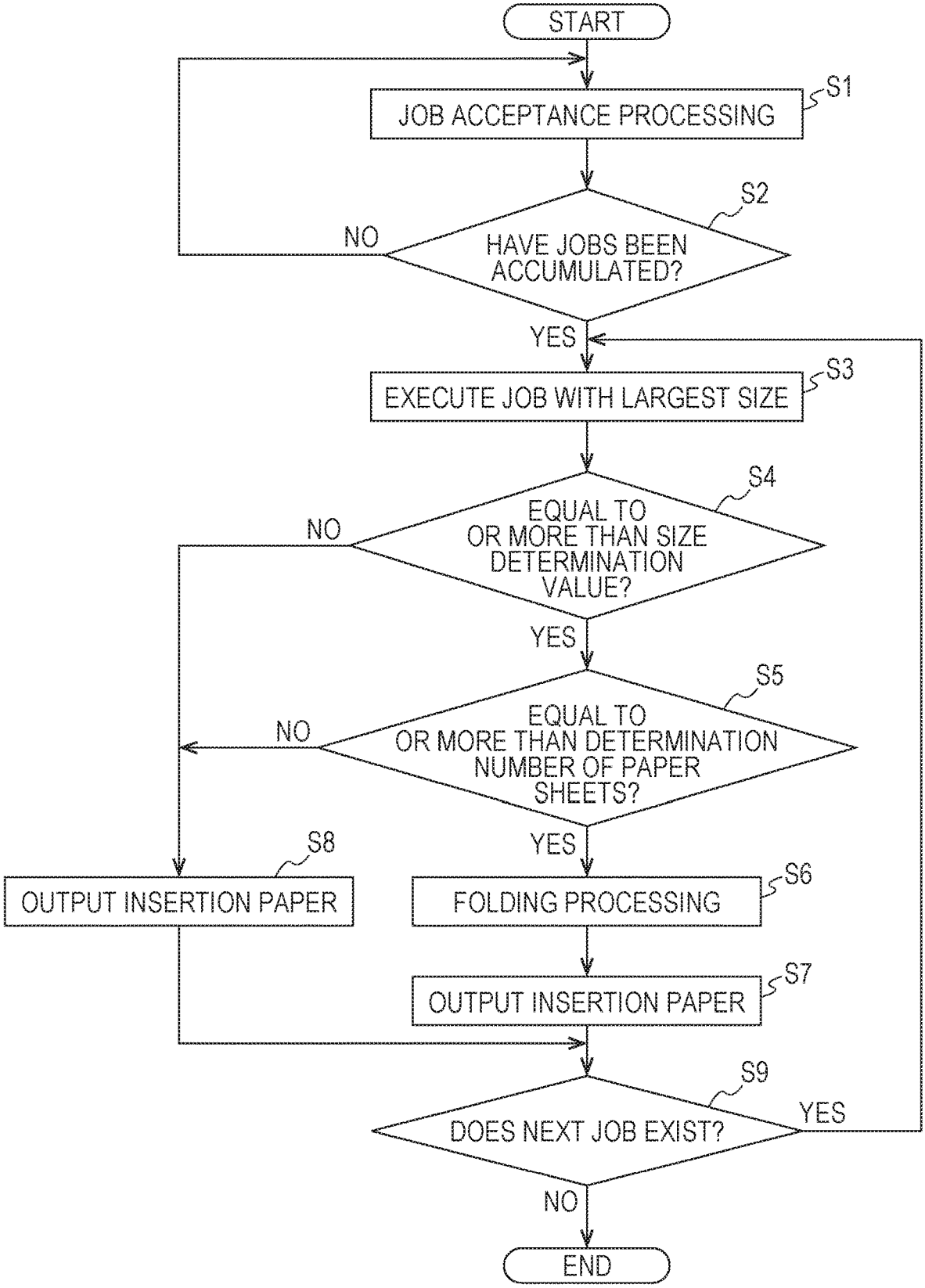
FIG. 4 is a flowchart of an operation of the image forming system.

Hereinafter, an operation of the image forming system 1 according to the present embodiment will be described. Here, FIG. 4 is a flowchart of an operation of the image forming system 1. The processing illustrated in the flowchart is executed by the CPU 11.

First, the CPU 11 executes job acceptance processing in step 1 (S1). Specifically, the CPU 11 monitors an input of a job while waiting for a certain period of time. When a job has been input, the CPU 11 labels the job and temporarily stores the labeled job in the hard disk drive 13.

In step 2 (S2), the CPU 11 determines whether a certain amount of jobs have been accumulated. Basically, this determination is made based on the number of accumulated jobs. However, it is possible to determine that the certain amount of jobs are accumulated if a total amount of the paper sheets P output when the accumulated jobs are executed reaches a specified amount.

In a case where the determination is affirmative in step 2, that is, in a case where a certain amount of jobs have been accumulated, the procedure proceeds to step 3 (S3), On the other hand, in a case where the determination is negative in step 2, that is, a certain of jobs have not been accumulated, the procedure returns to step 1.

In step 3, the CPU 11 controls the image forming device 2 and the post-processing device 3 to execute a job using the largest paper sheet P from among the accumulated jobs. By executing the job, an image is formed on the paper sheet P by the image forming device 2, and the paper sheet P is output to the post-processing device 3. Then, the post-processing device 3 executes the post-processing on the paper sheet P as necessary, and the paper sheet P is output to the paper sheet stacking device 4. The output paper sheet P is sequentially stacked on the paper discharge tray 41. When the execution of the job is completed, the CPU 11 deletes the job from the hard disk drive 13.

In step 4 (S4), the CPU 11 determines where a difference between the size of the paper sheet P used for the previous job, that is, the job executed in step 3 and the size of the insertion paper I is equal to or larger than the predetermined size determination value. Here, the size of the paper sheet P used for the previous job corresponds to the size of the uppermost paper sheet P on the paper discharge tray 41. When the insertion paper I is placed on the uppermost paper sheet P on the paper discharge tray 41, if a region which extends beyond the uppermost paper sheet P is too large, the insertion paper I drops due to self-weight. The size determination value in step 4 is a size difference which may cause the drop of the insertion paper I and which has been determined in advance, and an optimum value is set through experiments and simulations. The size of the uppermost paper sheet P is a basic size of the paper sheet P. However, in a case where the post-processing is executed by the post-processing device 3 and the outer shape of the paper sheet P is changed, the size is a size of the paper sheet P defined by the outer shape on which the post-processing has been executed.

In a case where the determination is affirmative in step 4, that is, the size difference is equal to or larger than the size determination value, the procedure proceeds to step 5 (S5). On the other hand, in a case Where the determination is negative in step 4, that is, the size difference is smaller than the size determination value, the procedure proceeds to step 8 (S8).

In step 5, the CPU 11 determines whether the number of printed paper sheets used for the job in which the uppermost paper sheet P on the paper discharge tray 41 is output (previous job) is equal to or more than a preset determination number of sheets. As the number of printed paper sheets P used for the previous job is larger, the insertion paper I tends to easily drop. The determination number of paper sheets in step 4 is the number of sheets which may cause the drop of the insertion paper I and which has been determined in advance, and an optimum value is set through experiments and simulations.

In a case where the determination is affirmative in step 5, that is, in a case where the number of printed paper sheets used for the previous job is equal to or more than the determination number of sheets, the procedure proceeds to step 6 (S6). On the other hand, in a case where the determination is negative in step 5, that is, in a case where the number of printed paper sheets used for the previous job is less than the determination number of sheets, the procedure proceeds to step 8.

In step 6, the CPU 11 controls the post-processing device 3 and executes the folding processing for folding the insertion paper I. Specifically, the CPU 11 determines a folding position of the insertion paper I based on the size of the uppermost paper sheet P and the size of the insertion paper I. Then, when the CPU 11 controls the post-processing device 3, the folding processor 31 of the post-processing device 3 folds the insertion paper I based on the folding position. Hereinafter, a specific mode of the folding processing relative to the insertion paper I executed by the folding processor 31 will be described. Here, FIGS. 5A and 5B and FIGS. 6A to 6C are explanatory diagrams illustrating modes of the folding processing.

Figure 5A:
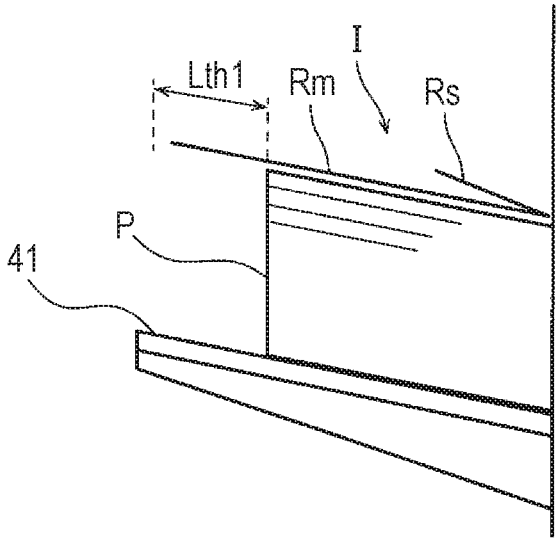
FIGS. 5A and 5B are explanatory diagrams of modes of folding processing.

In the folding processing, as illustrated in FIG. 5A, the folding processor 31 folds the insertion paper I at a position where the size difference between the uppermost paper sheet P and the insertion paper I is equal to or less than a constant value Lth1. To make a paper sheet function as insertion paper I, the size of the folded insertion paper I needs to be larger than the size of the uppermost paper sheet P. Furthermore, the constant value Lth1 is determined based on the difference between the sizes which does not cause the drop of the insertion paper I.

Figure 5B:
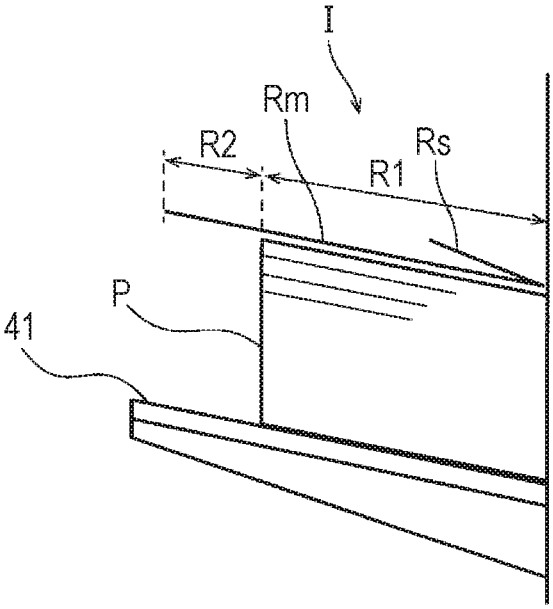

Alternatively, as illustrated in FIG. 5B, when the folded insertion paper I is placed on the uppermost paper sheet P, the folding processor 31 folds the insertion paper I at a position where the center of gravity of the insertion paper I is positioned in a first region R1 overlapped with the uppermost paper sheet P which is different from a second region R2 which extends beyond the uppermost paper sheet P.

At this time, the folding processor 31 folds the insertion paper I so that a side of the insertion paper I overlapped with the uppermost paper sheet P is heavier. As illustrated in FIGS. 5A and 5B, an angle of the paper discharge tray 41 is set to an inclined angle so that a rear end of the stacked paper sheet P (rear end defined with reference to the time of paper sheet conveyance) is positioned to be lower. Therefore, the paper sheets P on the paper discharge tray 41 are stacked so that the rear end sides are aligned. Therefore, the folding processor 31 normally folds the insertion paper I at the folding position on the rear end sides of the insertion paper I.

Furthermore, the folded state of the insertion paper I may be either one of upward folding and downward folding. The folded state can be determined according to the characteristics of the folding processor 31 included in the post-processing device 3. When the folding processor 31 is used for upward folding, the folding processor 31 performs upward folding, and when the folding processor 31 is used for downward folding, the folding processor 31 performs downward folding. Furthermore, in a case where the post-processing device 3 includes folding processors 31 which can respectively cope with upward folding and downward folding, in consideration of setting conditions of the user, the CPU 11 may select one of upward folding and downward folding and execute the selected folding processing.

Figure 6A:
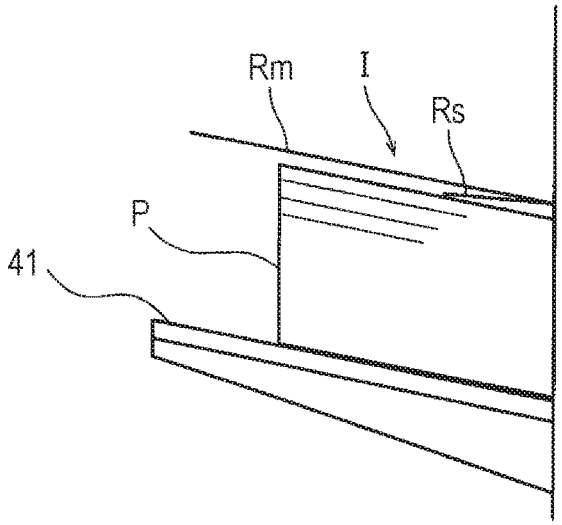
FIGS. 6A to 6C are explanatory diagrams of modes of folding processing.

In this case, by performing the downward folding on the insertion paper I, as illustrated in FIG. 6A, the folded region Rs is hidden under the main region Rm.

Figure 6B:
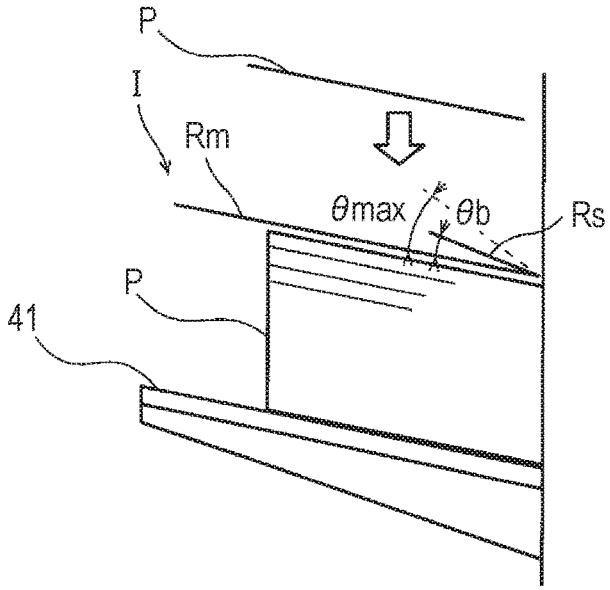

On the other hand, as illustrated in FIG. 6B, in a case where the upward folding is performed on the insertion paper I, the folding processor 31 folds the insertion paper I with a folding force equal to or stronger than the predetermined set value so that the folded angle θb is equal to or less than the maximum folded angle θmax. The maximum folded angle θmax is a set value to execute the folding processing so that the subsequent paper sheet P which is output subsequent to the insertion paper I is overlapped on the folded region Rs.

Figure 6C:
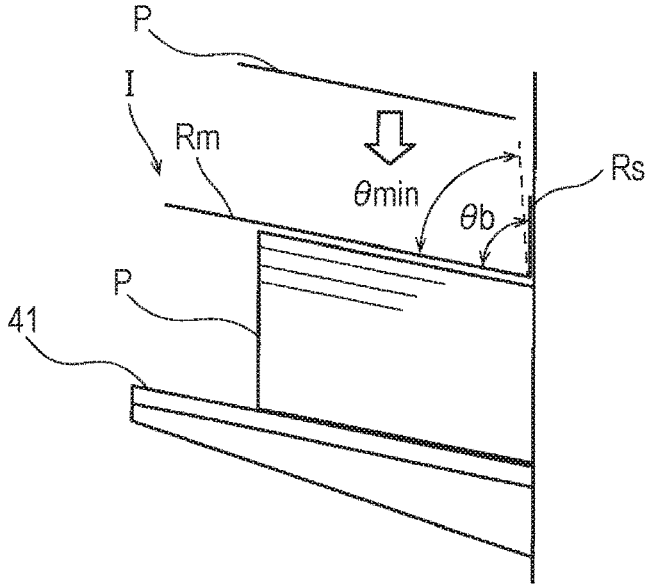

Alternatively, as illustrated in FIG. 6C, in a case where the upward folding is performed on the insertion paper I, the folding processor 31 folds the insertion paper I with a folding force equal to or weaker than the predetermined set value so that the folded angle θb is equal to or more than the minimum folded angle θmin. The minimum folded angle θmin is a set value to execute the folding processing so that the subsequent paper sheet P output subsequent to the insertion paper I is positioned on the valley side of the folded insertion paper I.

In consideration of these two upward folding states, the folding force by the folding processor 31 is realized by adjusting the pair of folding rollers 32 and 33 so as to realize one of the two upward folding states. In addition, if the interval between the pair of folding rollers 32 and 33 can be dynamically changed, in consideration of the setting conditions of the user and the like, the interval between the pair of folding rollers 32 and 33 may be dynamically changed so that the CPU 11 can obtain a desired folding force.

Referring again to FIG. 4, in step 7 (S7), the CPU 11 controls the post-processing device 3 and outputs the insertion paper I on which the folding processing has been performed to the paper sheet stacking device 4. The output insertion paper I is placed on the uppermost paper sheet P on the paper discharge tray 41, that is, the final paper sheet P of the previous job.

In step 8, the CPU 11 controls the post-processing device 3 and outputs the insertion paper I to the paper sheet stacking device 4. At this time, the post-processing device 3 outputs the insertion paper I without executing the folding processing on the insertion paper I. The output insertion paper I is placed on the uppermost paper sheet P on the paper discharge tray 41, that is, the final paper sheet P of the previous job.

In step 9 (S9), the CPU 11 determines whether the next job exists, that is, whether the accumulated jobs remain. In a case where the determination is affirmative in step 9, that is, in a case Where the accumulated jobs remain, the procedure returns to step 3. On the other hand, in a case where the determination is negative in step 9, that is, in a case where there is no remaining accumulated job, this routine ends.

As described above, according to the present embodiment, in a case where the insertion paper I is placed on the uppermost paper sheet P on the paper discharge tray 41, the CPU 11 executes insertion paper processing control. In the insertion paper processing control, in a case where it is determined that the size of the insertion paper I is larger than the size of the uppermost paper sheet P by a predetermined size determination value or more, the folding processor 31 changes the outer shape of the insertion paper I and changes the size of the insertion paper I, and then, the insertion paper I is output to the paper sheet stacking device 4.

With this configuration, in a case where the insertion paper I is placed on the uppermost paper sheet P on the paper discharge tray 41, the size of the insertion paper I is changed as necessary. Therefore, a situation in which the insertion paper I is largely extended beyond the uppermost paper sheet P can be prevented. As a result, the drop of the insertion paper I due to the self-weight can be prevented. This makes it possible to appropriately insert the insertion paper I regardless of a size of a paper sheet P used for a job.

Furthermore, according to the present embodiment, in a case where the number of printed paper sheets P used for the job in which the uppermost paper sheet P has been output is equal to or more than the determination number of the paper sheets which has been preset, the insertion paper processing control is executed. In a case where the number of printed paper sheets used for the job in which the uppermost paper sheet P has been output is large, the insertion paper I tends to easily drop. However, according to the present embodiment, the drop of the insertion paper I can be appropriately prevented. In addition, since it is not necessary to uniformly execute the insertion paper processing control on all the jobs, a deterioration in throughput can be suppressed.

In the present embodiment, the number of printed paper sheets used for the job has been considered. However, the number of all the stacked paper sheets P on the paper discharge tray 41 may be considered.

Furthermore, according to the present embodiment, the outer shape of the insertion paper I is changed so that the size difference between the changed insertion paper I and the uppermost paper sheet P is equal to or less than the constant value Lth1. With this configuration, since the insertion paper I is not excessively extended beyond the uppermost paper sheet P, the drop of the insertion paper I can be appropriately prevented.

Furthermore, according to the present embodiment, by using the folding processor 31, the size of the insertion paper I is changed by folding the insertion paper I along the paper sheet width direction CD perpendicular to the paper sheet conveyance direction FD. As a result, since the size difference between the insertion paper I and the uppermost paper sheet P is reduced, the drop of the insertion paper I can be appropriately prevented.

According to the present embodiment, when the folded insertion paper I is placed on the uppermost paper sheet P, the insertion paper I is folded so that the center of gravity of the insertion paper I is positioned in the first region R1 overlapped with the uppermost paper sheet P which is different from the second region R2 which extends beyond the uppermost paper sheet P. As a result, since the center of gravity of the insertion paper I is biased toward the first region R1, the drop of the insertion paper I can be appropriately prevented.

Alternatively, according to the present embodiment, the insertion paper I is folded so that the size difference between the folded insertion paper I and the uppermost paper sheet P is equal to or less than the constant value Lth1. With this configuration, since the insertion paper I is not excessively extended beyond the uppermost paper sheet P, the drop of the insertion paper I can be appropriately prevented.

Furthermore, according to the present embodiment, the insertion paper I can be folded downward so that the folded region Rs is folded over toward the lower side of the paper surface. Therefore, when the subsequent paper sheet P is stacked, the paper sheet P can be stacked without interfering with the folded region Rs.

In addition, according to the present embodiment, the insertion paper I can be folded upward so that the folded region Rs is folded over toward the upper side of the paper surface.

In this case, the insertion paper I is folded with a folding force equal to or stronger than the predetermined set value so that the subsequent paper sheet P output to the paper sheet stacking device 4 subsequent to the insertion paper I is stacked on the folded region Rs. Accordingly, when the subsequent paper sheet P is stacked, the folded region Rs does not disturb stacking, and the paper sheets P can be orderly stacked.

Alternatively, the insertion paper I is folded with a folding force equal to or weaker than the predetermined set value so that the subsequent paper sheet P output to the paper sheet stacking device 4 subsequent to the insertion paper I is positioned on the valley side of the folded insertion paper I. Accordingly, when the subsequent paper sheet P is stacked, the folded region Rs does not disturb stacking, and the paper sheets P can be orderly stacked.

Furthermore, according to the present embodiment, after the plurality of input jobs is accumulated, the jobs are sequentially executed from the job which uses a large paper sheet P from among the plurality of accumulated jobs. As a result, since the paper sheets P are sequentially stacked on the paper discharge tray 41 from the paper sheet P having a larger size, the paper sheets P can be orderly stacked even when the paper sheets P used for multiple jobs are mixedly stacked.

Second Embodiment

Hereinafter, an image forming system 1 according to a second embodiment will be described. A difference between the image forming system 1 according to the second embodiment and that according to the first embodiment is a method of changing the size of the insertion paper I. The description on the components overlapping with those in the first embodiment is omitted, and the differences will be mainly described below.

Figure 7:
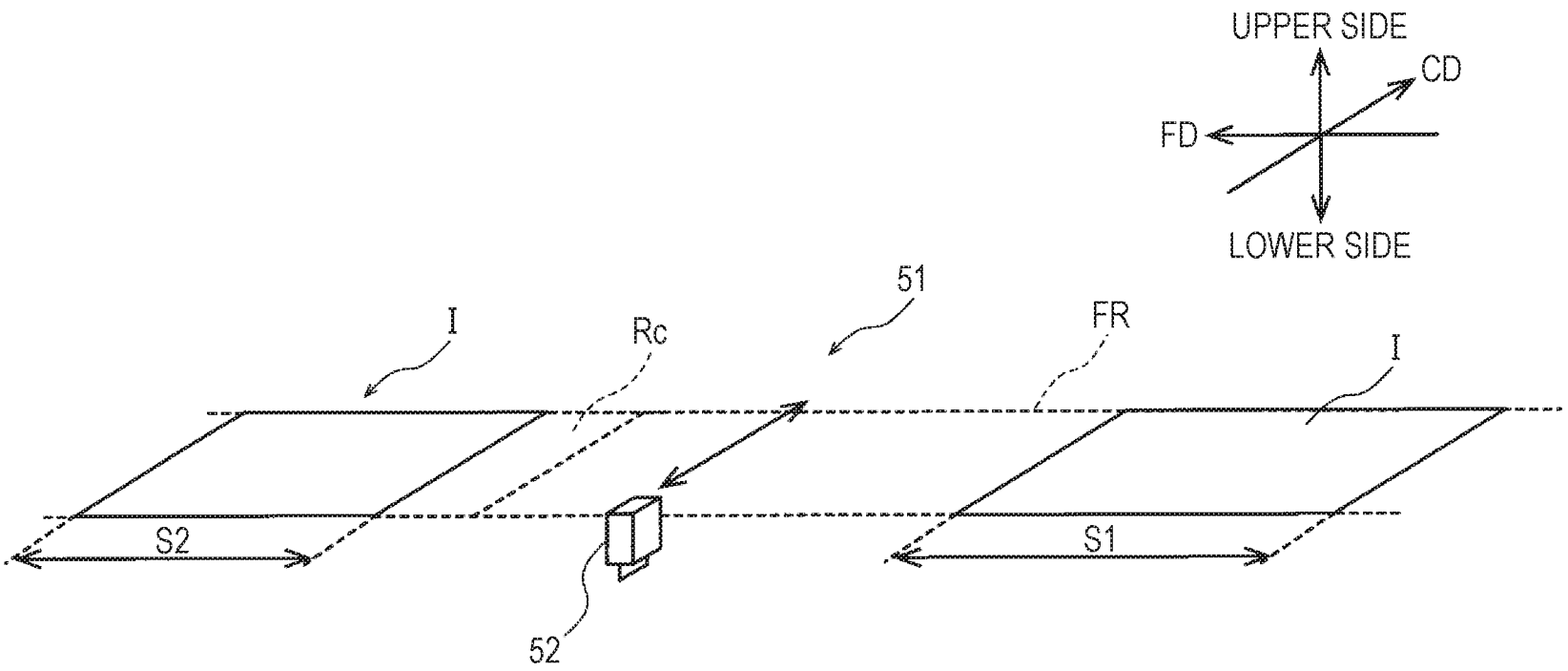
FIG. 7 is an explanatory diagram schematically illustrating a configuration of a cutting processor.

FIG. 7 is an explanatory diagram schematically illustrating a configuration of a cutting processor 51. A post-processing device 3 according to the present embodiment includes the cutting processor 51. The cutting processor 51 executes cutting processing for cutting a paper sheet P as post-processing relative to the paper sheet P (post-processor). The cutting processor 51 mainly includes a cutting blade 52 and a driving mechanism (not shown). The cutting blade 52 is linearly movable along a paper sheet width direction CD. By receiving a driving force from the driving mechanism, the cutting blade 52 can reciprocate along the paper sheet width direction CD.

The cutting processing executed by the cutting processor 51 will be described. Hereinafter, cutting processing relative to the insertion paper I will be exemplified. However, the same applies to processing relative to the paper sheet P on which an image has been formed. First, the insertion paper I to be conveyed through a conveyance path FR is stopped at a predetermined position. Thereafter, the cutting blade 52 is moved toward the paper sheet width direction CD. When the cutting blade 52 is moved, the insertion paper I is cut off in association with the movement, a part of the insertion paper I is separated. When an operation of cutting the insertion paper I is completed, the cutting blade 52 is moved backward and returns to the initial position.

In whit way, by cutting the insertion paper I along the paper sheet width direction CD, the cutting processor 51 can change the size of the insertion paper I by cutting off a part of the insertion paper I. In other words, the insertion paper I on which the cutting processing has been executed has a size S2 which is smaller than a size S1 before the cutting processing by a cut region Rc.

Furthermore, by controlling the position where the insertion paper I is stopped relative to the cutting processor 51, the cutting position of the insertion paper I can be adjusted. That is, by controlling the stop position of the insertion paper I, the size of the insertion paper I can be freely adjusted.

In this way, according to the present embodiment, by changing the size of the insertion paper I in a case where the insertion paper I is placed on the uppermost paper sheet P on the paper discharge tray 41, a situation in which the insertion paper I is largely extended beyond the uppermost paper sheet P can be prevented. As a result, the drop of the insertion paper I due to the self-weight can be prevented. This makes it possible to appropriately insert the insertion paper I regardless of a size of a paper sheet P used for a job.

In particular, by using the cutting processor 51, the size of the insertion paper I is changed by cutting the insertion paper I along the paper sheet width direction CD perpendicular to the paper sheet conveyance direction FD. As a result, since the size difference between the insertion paper I and the uppermost paper sheet P is reduced, the drop of the insertion paper I can be appropriately prevented.

The image forming system according to the embodiments of the present invention has been described above. However, the present invention is not limited to the embodiments and can be variously modified within the scope of the invention. In addition to the image forming system, the post-processing device of the image forming system, the control method of the image forming system, the program for causing a computer to execute the control method function as a part of the present invention. In addition, a computer readable recording medium for storing the program functions as a part of the present invention.

Furthermore, it is preferable that the image forming system include functions indicated in the image former, the post-processor, and the paper sheet stacker, and it is not necessary for the image former, the post-processor, and the paper sheet stacker to be distinguished by being housed in independent housings. For example, a part of the post-processing device may include the paper sheet stacker.

Furthermore, in the present embodiment, the insertion paper has been described as a partition for partitioning a pair of paper sheets forming a boundary between the jobs. However, the insertion timing of the insertion paper is not limited to this. For example, in a single job for performing printing on a plurality of groups, the insertion paper may be used to partition between paper sheets at a boundary between the groups.

In the present embodiment, the size of the paper sheet in the paper sheet conveyance direction is considered. However, the size of the paper sheet in the paper sheet width direction may be considered in the present invention. Similarly, both the paper sheet conveyance direction and the paper sheet width direction may be considered.

Although embodiments of the present invention have been described and illustrated in detail, the disclosed embodiments are made for purposes of illustration and example only and not limitation. The scope of the present invention should be interpreted by terms of the appended claims.

What is claimed is:

1. An image forming system comprising:

an image former that forms an image on a paper sheet;

a post-processor that executes post-processing on the paper sheet;

a paper sheet stacker that stacks the paper sheet output from the post-processor on a paper discharge tray; and a hardware processor that controls the image former, the post-processor, and the paper sheet stacker, wherein the hardware processor, in a case where an insertion paper sheet for partitioning paper sheets by being inserted between the paper sheets is to be output to the paper sheet stacker and placed on an uppermost paper sheet stacked on the paper discharge tray, determines whether to change a size of the insertion paper sheet based on at least one of an original size of the insertion paper sheet and a size of the uppermost paper sheet, and wherein in a case where the hardware processor determines to change the size of the insertion paper sheet, the hardware processor executes insertion paper sheet processing control for (i) changing the size of the insertion paper sheet by using the post-processor and (ii) outputting the insertion paper sheet to the paper sheet stacker.

2. The image forming system according to claim 1, wherein in a case where the hardware processor determines that a number of printed paper sheets used for a job in which the uppermost paper sheet has been output is equal to or more than a predetermined determination number of paper sheets, the hardware processor executes the insertion paper sheet processing control.

3. The image forming system according to claim 1, wherein in the insertion paper sheet processing control, the post-processor changes the size of the insertion paper sheet so that a size difference between the changed insertion paper sheet and the uppermost paper sheet is equal to or less than a predetermined value.

4. The image forming system according to claim 1, wherein the post-processor has a folding function that folds the insertion paper sheet and thereby changes the size of the insertion paper sheet by folding the insertion paper sheet along a width direction perpendicular to a conveyance direction thereof.

5. The image forming system according to claim 4, wherein the post-processor folds the insertion paper so that, when the folded insertion paper sheet is placed on the uppermost paper sheet, a center of gravity of the folded insertion paper sheet is positioned in a first region of the folded insertion paper sheet, the first region being overlapped with the uppermost paper sheet and being different from a second region of the folded insertion paper sheet which extends beyond the uppermost paper sheet.

6. The image forming system according to claim 4, wherein in the insertion paper sheet processing control, the post-processor folds the insertion paper sheet so that a size difference between the folded insertion paper sheet and the uppermost paper sheet is equal to or less than a predetermined value.

7. The image forming system according to claim 4, wherein the post-processor folds the insertion paper sheet so that a folded region of the folded insertion paper sheet is folded downward toward a lower side of a paper sheet surface.

8. The image forming system according to claim 4, wherein the post-processor folds the insertion paper sheet so that a folded region of the folded insertion paper sheet is folded upward toward an upper side of a paper sheet surface.

9. The image forming system according to claim 8, wherein the post-processor folds the insertion paper sheet with a folding force equal to or stronger than a predetermined set value so that a subsequent paper sheet output to the paper sheet stacker subsequent to the insertion paper sheet is stacked on the folded region of the folded insertion paper sheet.

10. The image forming system according to claim 8, wherein the post-processor folds the insertion paper sheet with a folding force equal to or less than a predetermined set value so that a subsequent paper sheet output to the paper sheet stacker subsequent to the insertion paper sheet is positioned on a valley side of the folded insertion paper sheet.

11. The image forming system according to claim 1, wherein the hardware processor accumulates a plurality of jobs input to the image forming system, and then, executes the plurality of accumulated jobs in order from a job which uses a largest paper sheet.

12. The image forming system according to claim 1, wherein the hardware processor determines whether to change the size of the insertion paper sheet based on a difference between the original size of the insertion paper sheet and the size of the uppermost paper sheet.

13. The image forming system according to claim 12, wherein the hardware processor determines to change the size of the insertion paper sheet when the difference is equal to or more than a predetermined value.

14. A control method of an image forming system, the image forming system including an image former that forms an image on a paper sheet; a post-processor that executes post-processing on the paper sheet; and a paper sheet stacker that stacks the paper sheet output from the post-processor on a paper discharge tray, and the control method comprising:

in a case where an insertion paper sheet for partitioning paper sheets by being inserted between the paper sheets is to be output to the paper sheet stacker and placed on an uppermost paper sheet stacked on the paper discharge tray, determining whether to change a size of the insertion paper sheet based on at least one of an original size of the insertion paper sheet and size of the uppermost paper sheet;

in a case where it is determined to change the size of the insertion paper sheet, changing the size of the insertion paper sheet by using the post-processor; and outputting the insertion paper sheet, the size of which has been changed, to the paper sheet stacker.

15. A non-transitory recording medium storing a computer readable program for causing a computer to execute a control method of an image forming system, the image forming system including an image former that forms an image on a paper sheet; a post-processor that executes post-processing on the paper sheet; and a paper sheet stacker that stacks the paper sheet output from the post-processor on a paper discharge tray, and the control method including:

in a case where an insertion paper sheet for partitioning paper sheets by being inserted between the paper sheets is to be output to the paper sheet stacker and placed on an uppermost paper sheet stacked on the paper discharge tray, determining whether to change a size of the insertion paper sheet based on at least one of an original size of the insertion paper sheet and size of the uppermost paper sheet;

in a case where it is determined to change the size of the insertion paper sheet, changing the size of the insertion paper sheet by using the post-processor; and outputting the insertion paper sheet, the size of which has been changed, to the paper sheet stacker.

* * * * *